United States Patent [19]

Leinhaas

[11] 4,302,961

[45] Dec. 1, 1981

[54] PRESS OR SIMILAR MACHINE TOOL

[76] Inventor: Werner Leinhaas, Leipziger Str. 40 a, 6460 Gelnhausen, Fed. Rep. of Germany

[21] Appl. No.: 79,946

[22] Filed: Sep. 28, 1979

[30] Foreign Application Priority Data

Jun. 23, 1979 [DE] Fed. Rep. of Germany ..... 2925416

[51] Int. Cl.[3] ..... B21J 9/18

[52] U.S. Cl. ..... 72/451; 72/453.03; 72/455; 100/286

[58] Field of Search ..... 72/451, 455, 453.03, 72/453.02; 100/286, 272; 74/520

[56] References Cited

U.S. PATENT DOCUMENTS

| | | | |
|---|---|---|---|
| 2,087,811 | 7/1937 | Patrick | 100/286 |
| 2,979,975 | 4/1961 | Schloz | 100/286 |
| 3,205,551 | 9/1965 | Neubauer | 100/286 |
| 4,013,003 | 3/1977 | Finsterwalder | 100/286 |

FOREIGN PATENT DOCUMENTS

| | | | |
|---|---|---|---|
| 2755962 | 2/1977 | Fed. Rep. of Germany . | |
| 45-24192 | 12/1970 | Japan | 72/451 |
| 383749 | 1/1965 | Switzerland | 100/286 |

*Primary Examiner*—Gene P. Crosby

*Attorney, Agent, or Firm*—W. G. Fasse; D. F. Gould

[57] ABSTRACT

A toggle-joint press or machine tool is easily adaptable to one of several common press drive mechanisms. Two forms of piston-in-cylinder (hydraulic or pneumatic) drives are disclosed as well as one form of a crank type drive.

15 Claims, 5 Drawing Figures

PRESS OR SIMILAR MACHINE TOOL

BACKGROUND OF THE INVENTION

Figure 1:
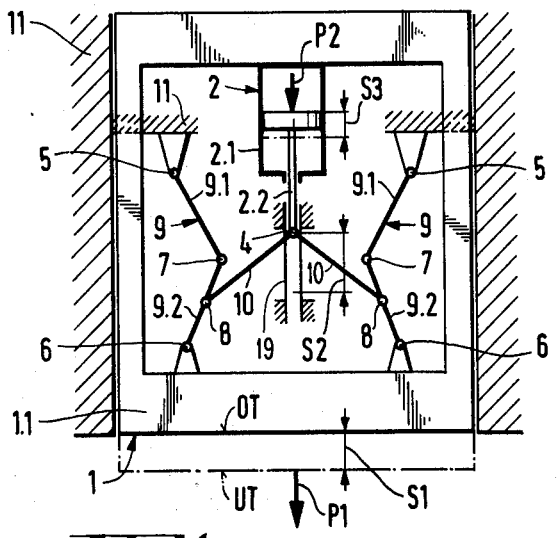

The present invention relates to a press or similar machine tool having a reciprocating tool carrier. The tool carrier is moved by means of two identical buckling toggle-lever systems. The toggle-lever systems are driven by a drive means supported on the tool carrier and located between the toggle-lever systems.

German Offenlegungsschrift No. 2,755,962, herein incorporated by reference, discloses a press of this type, in which the drive is effected by a crank drive located in the closed toggle-lever system.

Said prior art system, which combines the advantages of the toggle-lever presses with that of the crank drive in an almost ideal manner, is particularly suitable for automatic operation at high stroke frequencies. The asymmetrical arrangement of the press in the above cited publication, particularly in conjunction with a high rate of operation, causes the tool carrier especially the guide on the ram side to undergo high stress which can, depending on the particular usage, lead to rapid wear and tear.

The proposal to use a crank drive exclusively as the drive for toggle-lever presses is considered to be very restrictive, since this system is unsuited for universal application.

This is particularly true for presses the operation of which are subject to strict safety regulations, specifically with a view to precise braking and avoidance of over-run.

A crank device can, in general, meet these conditions with adequate safety but not with complete safety, in spite of the relatively low energy build-up in the drive system of such crank drive mechanisms.

Regardless of the above, the drive proposed in the above German Patent Publication offers several significant advantages. In contrast to conventional toggle-lever drives, the working shaft, with its eccentric power take-off, and hence the counter-force, need not be accommodated by the machine frame. Instead, the relatively light drive is located within the system. Thus, the counter-force largely acts, by virtue of the closed nature of the system, on the ram or tool carrier, whereby the machine stand or frame may be of lighter construction.

OBJECTS OF THE INVENTION

In view of the above it is the aim of the invention to achieve the following objects singly or in combination:

to provide a press, punch, key cutter or the like in which, while retaining the advantages of the above mentioned prior art, the drive is arranged to avoid any undue transverse stress on the tool carrier guides;

to provide a toggle-lever press or the like which uses other drive means as well as the crank-type drive; and to use in such a machine drive means other than a crank drive.

SUMMARY OF THE INVENTION

According to the invention these objects are achieved by a mechanism wherein there is provided either a hydraulic piston cylinder drive also referred to as a jack or a crank drive arranged in the free space between two toggle-lever pairs in a frame structure or tool carrier guided in the machine bed or support. In the version of the jack drive there are two embodiments.

The cylinder fixed and the piston driving the two toggle-lever pairs and the other where the piston is fixed and the toggle-levers are attached to the cylinder. In all cases the drive system is mounted to a frame construction which forms the tool carrier and is mounted for reciprocating movement in guides which form part of the machine bed or support. The toggle-lever pairs each have one end hinged to the machine bed or support and the opposite end hinged to the tool carrier. Intermediate the ends a further link is hinged to each toggle-lever pair and to the common drive member.

The construction of this press or similar machine tool in accordance with the invention firstly eliminates any possible stress on the tool carrier guides transversely to the stroke direction, and furthermore confines the movement of the drive means connected to the tool carrier solely to one direction, that is to say, to the stroke direction. In prior art constructions, movement of the crank drive both in the stroke direction and transversely to the stroke direction is possible. A further advantage of the present invention over this condition is that the hydraulic hoses through which the drive is supplied, and the hose connection, are subjected to substantially less stress.

Regardless of which arrangement is chosen, the hydraulic crank drive or one of the jack drives, the advantages of a completely closed drive system are fully realized, so that furthermore, the machine of the present invention requires about 50% of the drive energy which most present day hydraulic presses require.

When using a cylinder member which is fixed in the frame construction, or using a crank drive, the stroke of the tool carrier between the top and bottom dead-center points (TDC and BDC) is equal to the difference between the stroke traveled by the intermediate joint and the stroke traveled by the drive.

When using a cylinder member which is movable on a centrally fixed piston rod in the stroke direction only, the operation is as follows. When the cylinder member is in its upper and lower end positions of travel the tool carrier is always in the TDC position. When the cylinder member is at its mid-travel point the tool carrier is in the BDC position. Thus, for a complete stroke, starting from the upper or lower cylinder position, the TDC position is encountered twice and the BDC position once. The TDC position of the toggle-levers corresponds with maximum buckling and the BDC position with maximum extension.

This operation according to the invention has the advantage that in the course of executing a complete stroke on the piston rod, the cylinder, on reaching the bottom dead-center of the tool carrier, does not have to be braked and again accelerated away from this position. Therefore, the switching time for the change-over at BDC is saved.

BRIEF FIGURE DESCRIPTION

Figure 2:
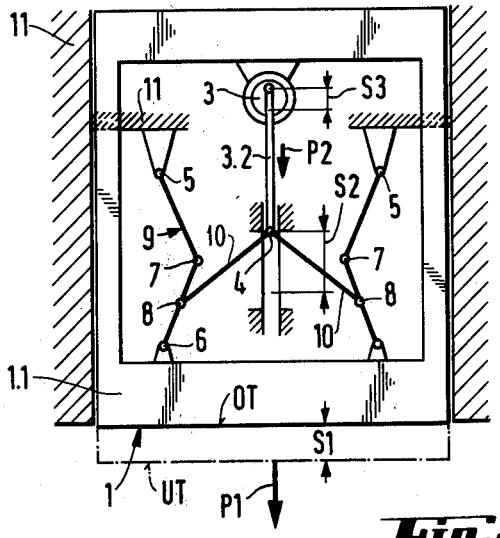
Figure 3A:
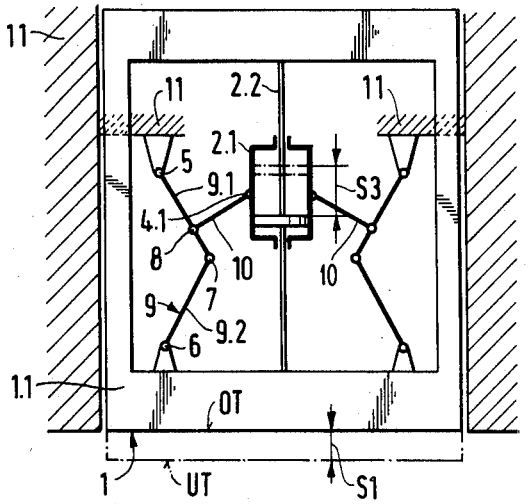
Figure 3B:
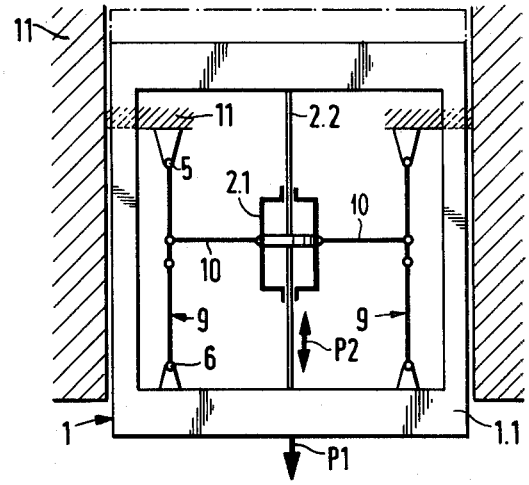
Figure 3C:
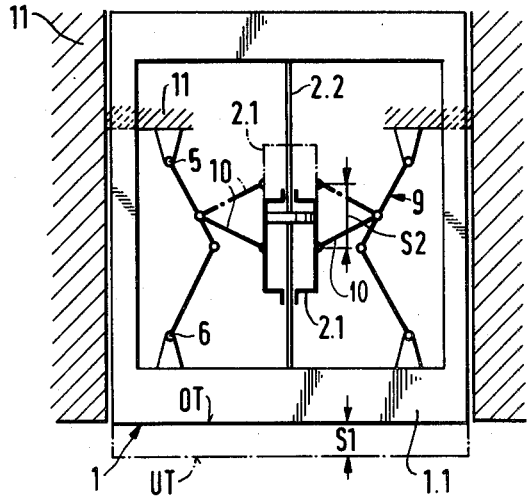

In order that the invention may be clearly understood, it will now be described, by way of example, with reference to the accompanying drawings, wherein:

FIG. 1 shows an embodiment with a jack drive, where the cylinder member is fixedly located on the frame construction of the tool carrier;

FIG. 2 shows an embodiment with the crank drive fixedly located on the frame construction of the tool carrier; and FIGS. 3A, 3B, and 3C show an embodiment employing a jack drive, with the piston rod fixed to the frame construction of the tool carrier, wherein FIG. 3A shows the position of the tool carrier in the TDC position and the cylinder in the upper position; wherein FIG. 3B shows the position of the tool carrier in the BDC position, with the cylinder in the middle position, and wherein FIG. 3C shows the position of the tool carrier in the TDC position, with the cylinder in the lower position.

DETAILED DESCRIPTION OF PREFERRED EXAMPLE EMBODIMENTS AND OF THE BEST MODE OF THE PRESENT INVENTION

In FIG. 1 the cylinder member 2.1 of the jack 2 is rigidly secured to the frame construction 1.1 of the tool carrier 1. The tool carrier 1 is slidably suspended in the machine base 11 via the two joints 5 fixedly located on the machine base 11, the toggle-lever pairs 9 and the joints 6 which are movable in the stroke direction. The individual toggle-levers 9.1 and 9.2 are in each case connected by the toggle joints 7 to form a toggle-lever pair 9.

The drive is effected, starting from the movable piston rod 2.2, through the central intermediate joint 4 fitted in the frame mounted guide 19 and the two intermediate members 10 so as to act on the joints 8, present on the toggle-lever pairs 9, by means of which the toggle-lever pairs 9 can be extended and buckled at the joints 7.

According to FIG. 2, the crank drive 3, with its power take-off connecting rod 3.2, is fixedly located in the frame construction 1.1 of the tool carrier 1. The connecting rod 3.2 terminates in the guide central intermediate joint 4. The remaining construction is identical with the construction according to FIG. 1.

For the embodiments according to FIG. 1 and according to FIG. 2, the stroke S1 of the tool carrier 1 from the top dead center to the bottom dead center, that is to say from the TDC to the BDC, is given by the equation:

$$S1=S2-S3 \text{ or } S3=S2-S1,$$

S3 being the stroke of the drive and S2 the stroke of the intermediate connecting members 10.

EXAMPLE

In a press constructed in accordance with these principles, and having a nominal force, 20% before reaching the BDC, of P1=100 kN, and a stroke S1 of 60 mm, the force P2=20 kN, the stroke S2 is 100 mm, and the stroke S3 is effectively 40 mm.

In an embodiment according to FIGS. 3A, B, and C, the piston rod 2.2 is fixedly located in the frame construction 1.1 of the tool carrier 1, and more especially is located centrally relative to the system.

Corresponding to intermediate joint 4 in the other embodiments are joints 4.1 attached to the moving cylinder member 2.1 in the same plane orthagonal to the stroke direction.

As may be seen from the individual positions A to C, the TDC position of the tool carrier 1 is achieved in both the upper and the lower position of the cylinder member 2.1, while in the middle position, that is to say with the toggle-lever pairs 9 extended, the BDC position of the tool carrier 1 is achieved. During a complete stroke starting from the upper or lower cylinder position, the TDC position is thus encountered twice and the BDC position once.

Although the invention has been described with reference to specific example embodiments, it is to be understood that it is intended to cover all modifications and equivalents within the scope of the appended claims.

What is claimed is:

1. A press or similar machine tool, comprising a frame type tool carrier (1), a pair of identical buckling toggle-lever systems (9) connected to said frame type tool carrier and to a machine base (11) which slidingly supports said tool carrier and a drive system (2 or 3) operatively connected to cause the buckling and elongating of said toggle lever systems thereby reciprocating the tool carrier, and mounting means mounting said drive system exclusively in said tool carrier.

2. The tool of claim 1, wherein the drive system output direction is in line with the direction of tool carrier reciprocation and is applied equally and simultaneously to each of said toggle-lever systems.

3. The tool of claim 2, wherein said toggle-lever systems are arranged at a distance from one another in a free space provided in said frame type tool carrier, with first end joints (5) of said toggle lever systems hinged to said machine base, opposite end joints (6) hinged to said tool carrier and movable in the reciprocating direction, buckling joints (7) of said toggle-lever pairs connected to said toggle-lever system for opposite mutual movement, and wherein the toggle-lever pairs are connected to said drive system (2 or 3) by means of hingedly mounted intermediate members (10).

4. The tool of claim 3, wherein the drive system comprises a rotary prime mover and an eccentrically mounted connecting rod for converting the rotary motion of the prime mover into reciprocating motion.

5. The tool of claim 3, wherein said drive system comprises a hydraulic cylinder (2.1) fixedly mounted to said tool carrier frame central to said toggle-lever systems and an operatively fitted piston and connecting rod.

6. The tool of claim 4 or 5, wherein the power output of the drive system is supported for movement colinear with said tool carrier by a central intermediate joint (4) which is fixed to the free end of said connecting rod and hinged to said intermediate members, and wherein the movement of said intermediate joint is restricted by a frame mounted guide (19).

7. The tool of claim 6, wherein the stroke (S1) of said tool carrier between its opposite extremes of movement is equal to the difference between the stroke (S2) of said intermediate joint and the stroke of said drive system.

8. The tool of claim 3, wherein the drive system comprises a piston and piston rod fixedly attached to said tool carrier and a co-acting hydraulic cylinder movable in the stroke direction to which said intermediate members are hingedly attached, whereby the furthest ends of travel of said cylinder member correspond to one end of travel of said tool carrier and the mid point of travel of said cylinder corresponds to the other end of travel of said tool carrier.

9. A press or similar machine tool, comprising a machine base (11), reciprocating tool carrier means (1) movably supported in said machine base (11) which guides the tool carrier means, two buckling, identical toggle-lever systems (9.1, 9.2) each including a buckling pivot joint (7) and first means operatively connecting the toggle-lever systems to said tool carrier means (1)

and to the machine base (11) for moving the tool carrier means, drive means supported by said tool carrier means between said toggle-lever systems, and second connecting means for operatively connecting said drive means to said toggle-lever systems as the central drive for both toggle-lever systems which are arranged at a distance from one another in a free space of the tool carrier means, said first connecting means comprising fixed pivot joints (5) connected to the machine base (11), and movable pivot joints (6) movable in the stroke direction and hinged to the tool carrier means, said second connecting means comprising hingedly mounted intermediate members (10) pivotally securing the drive means to the toggle-lever systems.

10. The tool of claim 9, wherein said drive means comprise stationary cylinder means, a movable piston rod, and guide means for said movable piston rod, said second connecting means being pivoted to the piston rod and to the respective toggle-lever system.

11. The tool of claim 9, wherein said drive means comprise movable cylinder means and a stationary piston rod, said second connecting means being pivoted to the movable cylinder means and to the respective toggle-lever system.

12. The tool of claim 9, wherein said drive means comprise a crank drive including a crank rod and guide means for said crank rod, said second connecting means being pivoted to said crank rod and to the respective toggle-lever system.

13. The tool of claim 10 or 12, wherein said guide means (4) are located centrally between the toggle-lever systems in the stroke direction of the respective rod.

14. The tool of claim 10 or 12, wherein said tool carrier means (1) driven by said drive means through said second connecting means perform a stroke (S1) between an upper and a loer dead center point, said drive means performing a stroke (S3), said second connecting means performing a translated stroke (S2) such that $S1=S2-S3$.

15. The tool of claim 11, wherein said movable cylinder means has outer return points forming first and second or upper and lower return points, and a central dead center position between said return points.

* * * * *